US007703364B2

(12) United States Patent
Jaksha

(10) Patent No.: US 7,703,364 B2
(45) Date of Patent: Apr. 27, 2010

(54) CARD SLOT PUNCH DEVICE

(76) Inventor: Steven Jaksha, 13618 Torrey Hill, San Diego, CA (US) 92130

( * ) Notice: Subject to any disclaimer, the term of this patent is extended or adjusted under 35 U.S.C. 154(b) by 248 days.

(21) Appl. No.: 11/184,320

(22) Filed: Jul. 19, 2005

(65) Prior Publication Data

US 2006/0032354 A1 Feb. 16, 2006

Related U.S. Application Data

(60) Provisional application No. 60/600,479, filed on Aug. 11, 2004.

(51) Int. Cl.
*B26D 1/25* (2006.01)
*B26F 1/14* (2006.01)
*B26F 1/32* (2006.01)

(52) U.S. Cl. ..... 83/467.1; 83/599; 83/685; 83/687; 83/691; 30/358

(58) Field of Classification Search ..... 83/467.1, 83/599, 605, 606, 685, 687, 688, 689, 691, 83/695, 468.1; 30/358, 361, 363, 364; 101/26, 101/30; 402/1, 4
See application file for complete search history.

(56) References Cited

U.S. PATENT DOCUMENTS

| | | | | | |
|---|---|---|---|---|---|
| 553,889 | A * | 2/1896 | Zander | 30/358 |
| 914,613 | A | 3/1909 | Storlie | |
| 1,845,203 | A * | 2/1932 | Sibley | 83/39 |
| 1,919,433 | A * | 7/1933 | Hutchings | 355/29 |
| 1,925,343 | A * | 9/1933 | Sibley | 83/41 |
| 2,558,567 | A | 3/1949 | Kaeser | |
| 2,847,759 | A * | 8/1958 | Jones | 30/229 |
| 3,431,591 | A | 3/1969 | Betso | |
| 4,240,572 | A * | 12/1980 | Mitsuhashi | 227/76 |
| 4,869,143 | A | 9/1989 | Merrick et al. | |
| 4,879,932 | A | 11/1989 | Scalise et al. | |
| 4,893,535 | A | 1/1990 | Bentrim et al. | |
| 4,930,928 | A | 6/1990 | Ristuccia | |
| 4,941,381 | A | 7/1990 | Garner | |
| 5,005,458 | A * | 4/1991 | Merrick | 83/599 |
| 5,490,440 | A * | 2/1996 | Karlis et al. | 83/599 |
| 5,503,052 | A * | 4/1996 | Rigney et al. | 83/467.1 |
| 5,555,785 | A | 9/1996 | Scalise et al. | |
| 5,611,254 | A | 3/1997 | Rall | |
| 6,076,447 | A * | 6/2000 | Damask | 83/618 |
| 6,581,501 | B2 * | 6/2003 | McGrath | 83/467.1 |
| 2002/0002890 | A1 * | 1/2002 | McGrath | 83/599 |

FOREIGN PATENT DOCUMENTS

| | | | |
|---|---|---|---|
| CA | 2263045 | * | 1/2000 |

* cited by examiner

*Primary Examiner*—Clark F. Dexter

(57) ABSTRACT

A punch device for punching parallel slots in sheets to facilitate the mounting of card-like objects on sheets. The device comprises a male plate on which at least one pair of cutting projections are mounted. The device also comprises a female plate moveably hinged to the male plate through which rectangular slots are formed, each slot being so positioned as to correspondingly face one of the cutting projections in the male plate. The hinge assembly comprises an axle part and a swivel part. The axle part comprises cams and the swivel part comprises grooves. The cams are positioned to penetrate the grooves and wrap around over an angle less than the whole circumference of the axle part.

20 Claims, 11 Drawing Sheets

CARD SLOT PUNCH DEVICE

FIELD OF THE INVENTION

This invention claims the benefit of US Provisional Application No. 60/600479 with the title, "Card Slot Punch Device" filed on Aug. 11, 2004 and which is hereby incorporated by reference. Applicant claims priority pursuant to 35 U.S.C. Par 119(e)(i). The present invention is an office stationary device paper punch. More specifically it relates to a light and portable paper punch used to cut precision slots into a letter to hold diagonally opposite corners of a card such as a business card.

BACKGROUND

To appreciate the innovative attributes of this invention, it is important to distinguish between paper-punch devices that produce slits and those that produce slots. In a slit, the paper is simply cut along a line segment, and no paper material is removed from the sheet. The edges of a slit touch each other. In a slot, the paper is cut according to an approximate rectangular shape. Paper material is removed and the edges of the slot do not touch each other. Because of their greater opening, a slot is significantly more convenient to use when inserting a business card than a slit. In addition, a slot is less likely to tear since its ends are rounded. While this particular "slit/slot" nomenclature is used in this patent application to distinguish between slits and slots, the prior art does not always make this distinction clearly.

In addition, it is also important to distinguish in the prior art those devices equipped with easily assembled/disassembled hinges from those with fixed hinges. Paper punches equipped with easily assembled/disassembled hinges have the potential of being significantly less expensive to manufacture and to assemble.

None of the devices described in the prior art achieves the combination of economy with functionality that this invention provides.

For example, the invention described in U.S. Pat. No. 914,613 by Storlie benefits from an economical design that consists of a simple rectangular sheet metal plate approximately folded in a springy V-shape and stamped to display sharp edges. When the device is pressed, the sharp edges cut slits in paper.

Another invention by Scalise, in U.S. Pat. No. 4,879,932 describes a paper punching device that produces slits. These slits are produced by "slitting blades" mounted on a first platen, that face "complementary slots formed in a second platen" In addition, the device cannot be easily assembled or disassembled.

The invention described in U.S. Pat. No. 4,893,535 by Bentrim produces slits: the punching element as described in all of its independent claims and in its FIG. 18 is a blade. The hinge used by that device cannot be easily disassembled.

U.S. Pat. No. 4,941,381 by Garner describes a paper punching device that produces slits. This is evidenced by the fact that the cutting element is a blade as described in its claim and in its FIG. 7A.

U.S. Pat. No. 5,611,254 by Rail describes a paper punch capable of making holes in a diversity of shapes including circular, semicircular, triangular and rectangular holes. This device, however, is complex: its hinges are fixed; the punching elements are metal rods as evidenced in that patent FIG. 5. The complexity of the device, together with its form factor which includes a large vertical dimensions gives the device a poor portability.

Hence, there is a need for a device capable of making slots, with a hinge mechanism that can be easily disassembled, and with a high portability.

It is therefore an object of this invention to provide greater safety by replacing tile sharp blade used in most other prior art by a blunt approximately squared-edged male projection that reciprocatingly engages into a female "slot."

It is an additional object of this invention to punch paper slots rather than paper slits to facilitate mounting of business cards or the like, and to increase the resistance to tears.

It is yet another advantage of this device to be cheaply assembled because of its hinged structure.

Further features, aspects, and advantages of the present invention will be more fully understood when considered with respect to the following detailed description, claims and accompanying drawings.

SUMMARY OF THE INVENTION

This invention is a paper punch device specially designed to punch slots to hold business cards or the like. It comprises two plates, a male plate comprising a number of projections and a female plate comprising an equal number of slots. The two plates are hinged together such that, in the closed position, the male projections fit exactly into the female slots. In addition, the edges of the projections and of the slots are sharp enough to punch slots into paper. Several embodiments are described such as a four punch device, a two punch device, a punch mechanism generating rectangular slots in paper, a punch mechanism generating slots with rounded edges, a male punch with a flat top, and a male punch with a concave top. The hinge of the device designed to facilitate the manufacturing process allows the device to be assembled or disassembled when it is open at an angle of approximately 270 degrees.

DETAILED DESCRIPTION

Figure 1:
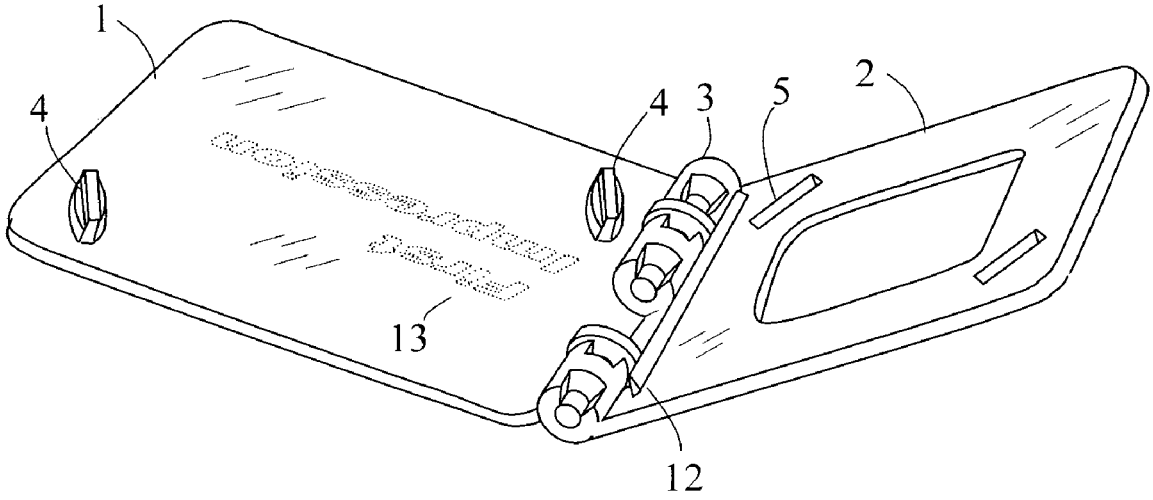
FIG. 1 illustrates a three dimensional view of a two-punch device.
Figure 1A:
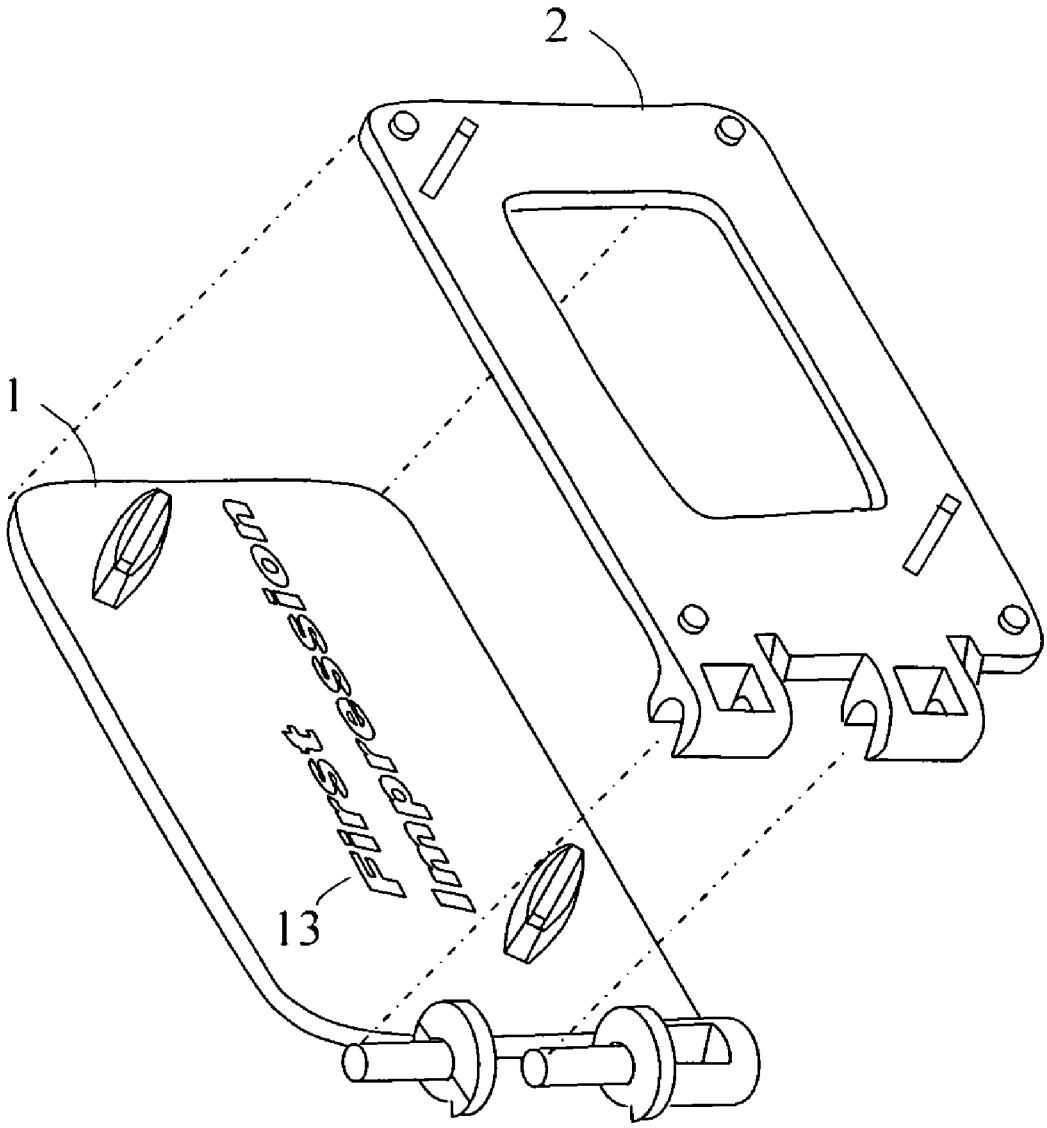
FIG. 1A provides a three-dimensional exploded view of the two punch device.

As shown in FIG. 1 this device is made in two separate plates 1 and 2 that can easily be joined together by means of a hinge 3 to form a paper punch specially designed to cut diagonally placed slots. FIG. 1A provides an exploded view of the device. The purpose of the device is to cut slots for mounting cards such as business cards on a sheet of paper, Bristol board or the like.

Figure 2:
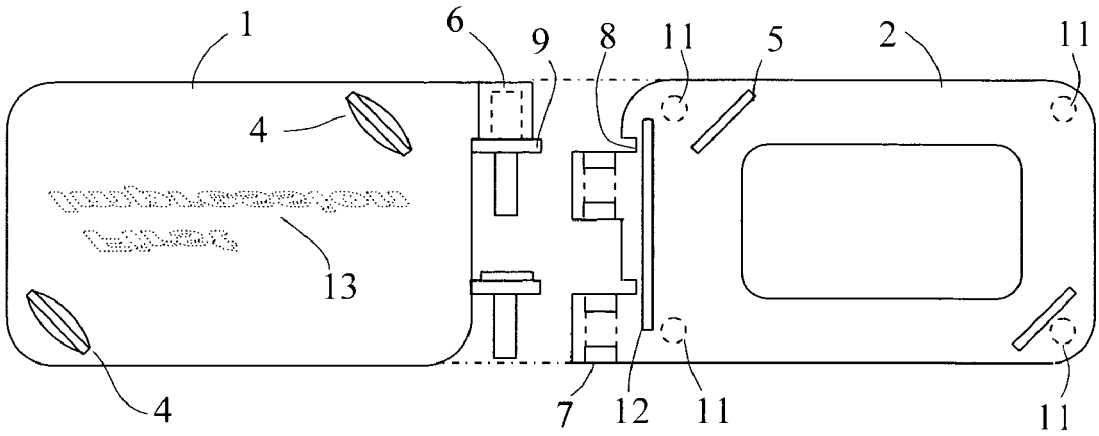
FIG. 2 illustrates an exploded view of the top view of a two-punch device.

FIG. 2 shows the two plates 1 and 2 disassembled. These plates are typically made of hard plastic material or the like and can be manufactured by an injection molding process, for example. They are hinged together at the shorter side of the rectangle. The male hinged plate 1 carries a set of protrusions 4 that form the male part of the punch, and the female plate 2 has a set of slots 5 that form the corresponding female part of the punch. In addition, each hinged plate carries either the male part 6 of the hinge 3 or the corresponding female part 7 of the hinge 3 or vice versa. (Assigning male hinge to male plate and female hinge to female plate is not necessary, and the assignment can be reversed.) Further, the punching device includes projecting portions 11.

Punch and Slot Mechanism.

The female plate 2 of the device comprises a hinged rectangle penetrated by small slots 5 at its corners. The slots 5 are approximately diagonal, being placed at about a 45 degree angle to the edge of the rectangle. The slots 5 are approximately 3 mm wide and 18.5 mm long. They penetrate the female hinged plate 2 completely forming a see-through rectangular hole.

The male plate 1 of the punch is hinged to the female plate 2 and carries punch projections 4. These male projections 4 are so placed that they insert themselves exactly into the slots 5 found on the female hinged plate 2 when the two hinged plates are brought together.

Several versions of this invention are described. The first version shown in FIG. 1 incorporates only two punches. Two projections are located at opposite corners of the male plate and two slots are located at corresponding corners of the female plate.

Figure 3:
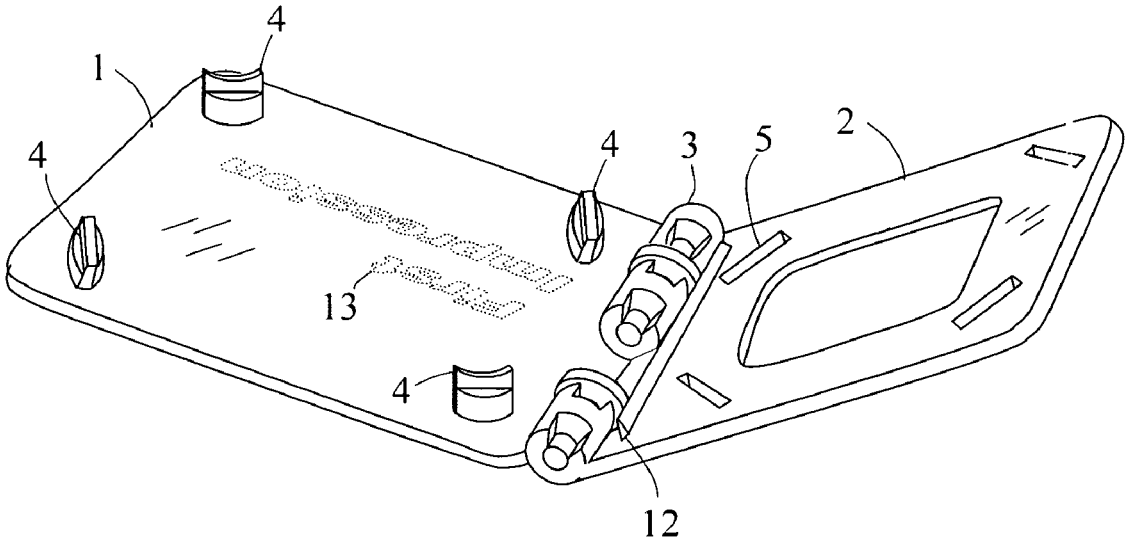
FIG. 3 shows a three dimensional view of a four-punch device.
Figure 4:
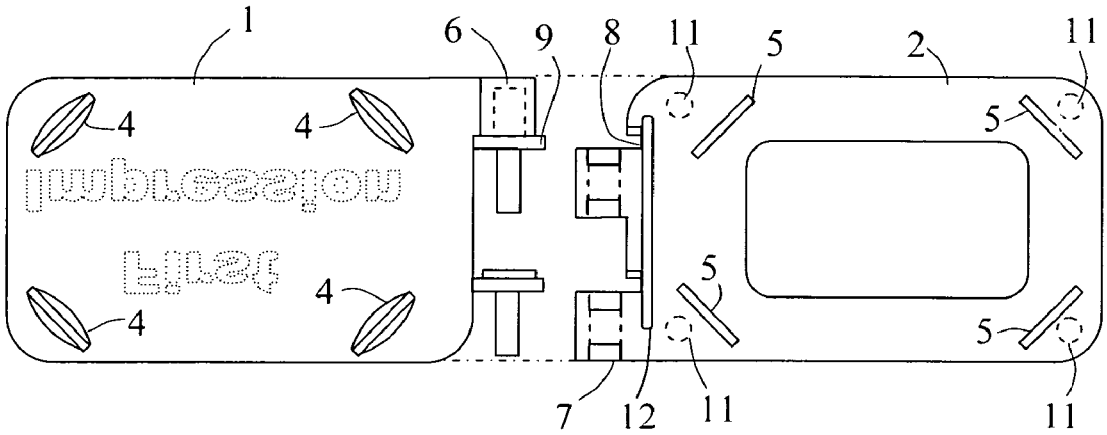
FIG. 4 provides an exploded view of the top view of a four-punch device.

In another version shown in FIG. 3 and 4, the invention comprises four punches consisting of one projection 4 at each corner of the male plate 1 and one slot 5 at each corner of the female plate 2.

Figure 5:
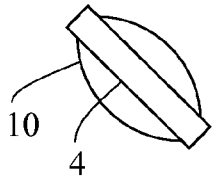
FIG. 5 illustrates a top view of the male projection equipped with a rectangular slot cutter.
Figure 6:
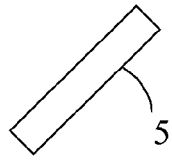
FIG. 6 illustrates a top view of the rectangular female slot.
Figure 7:
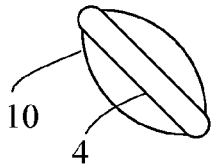
FIG. 7 shows a top view of the male projection equipped with a smooth-angled slot cutter.
Figure 8:
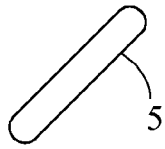
FIG. 8 provides a top view of a female slot with smooth angles.

The punches themselves can be made in different ways. As shown in FIGS. 5 and 6 the projections 4 and the slots 5 can be rectangular. In yet another version the punches and slots can be rectangular with rounded corners as shown in FIGS. 7 and 8. This design has the advantage of producing slots in paper with rounded corners to minimize stress and tearing.

Figure 9:
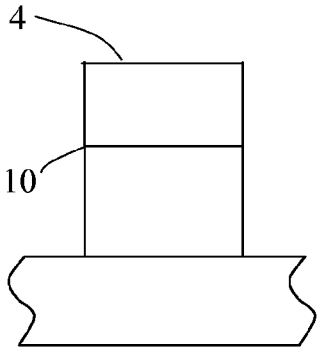
FIG. 9 shows a male punch projection equipped with a flat top.
Figure 10:
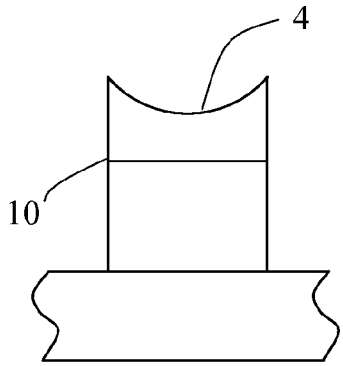
FIG. 10 illustrates a male punch projection equipped with a concave top.

These male punch projections 4 differ from simple blades in that they are shaped with their top approximately flat as shown in FIG. 9 or slightly concave as shown in FIG. 10, defining a cutting edge with angles between the top and the sides slightly less than or equal to 90 degrees. It is important to note that the angle is "sharp" in the sense that it is not rounded and is so designed to enable the projections to cut slots instead of slits in paper. The cutting surface of the punch is achieved by maintaining a sharp angle of 90 degree or slightly smaller at the edge where the vertical sides of the rectangular punch meet the concave surface face. The projections 4 are slightly smaller than the slots, that is, they are about 2.5 mm wide and 18 mm long. They are positioned exactly facing their corresponding slot 5 on the female hinged plate 2 when the punch mechanism is depressed. They have a height of about 2.5 mm sufficient to allow them to penetrate their slot 5.

It is important to note that, even though the absolute dimensions of the male projection and the slot are not critical, their relative dimensions are important and must conform to a "slip-fit." The term "slip-fit" applies to cases involving a tight tolerance.

The projection design of FIG. 10 showing a concave curve of the cutting edge allows the projection 4 to engage the corresponding slot 5 first from the outside edge and then work inward towards the center of the slot, cutting the paper as it penetrates into the slot.

The projections could have a width between 2 and 2.5 mm, a length of about 18 mm, and a height of about between 6 mm and 8 mm above said male plate. The slots should be slightly larger than the Cutting projection by a clearance ranging from 0.2 mm to 0.05 mm. Preferably the slots Should have a clearance ranging from 0.1 mm to 0.05 mm.

The male punch projections nearest the hinge can be altered to be approximately 1 mm shorter than the male punch projections farthest away from the hinge to compensate for the different lengths in the arc of the two plates as they swing to a close, thereby allowing the slots to be cut simultaneously.

Stop Mechanism.

As shown hi FIGS. 5, 7, 9 and 10 each hinged plate includes a stop system 10 to prevent "over-closure" in which the punch projections traverse the slot in its entirety thus becoming exposed and presenting a danger to the user.

The stop 10 could be incorporated into the base of the punch area and made approximately the same shape as, but slightly larger than, the slot 5. For example the stop 5 could have a length of about 18 mm in length, a width ranging from 5.0 mm to 7.0 mm and a height above the male plate ranging from 3.5 mm to 4 mm. Preferably, the width could be about 6.0 mm and the height about 4 mm above the above the base plate. Being larger than the slot, the stop 5 prevents the Cutting punch projection 4 from penetrating the slot 5 more than 2.5 mm.

Alternatively, the stop 10 could be located on the slot side, essentially creating a rim around the slot area. The slot would then become elevated in relation to the rest of the female hinged plate of the punch system.

In yet another variation, a combination of the two alternatives described above could be used, in which a first part of the stop would be provided by a thickening at the base of the punch projection and a second part, by an elevation of the slot above it, substrate.

Hinge Assembly

Figure 11:
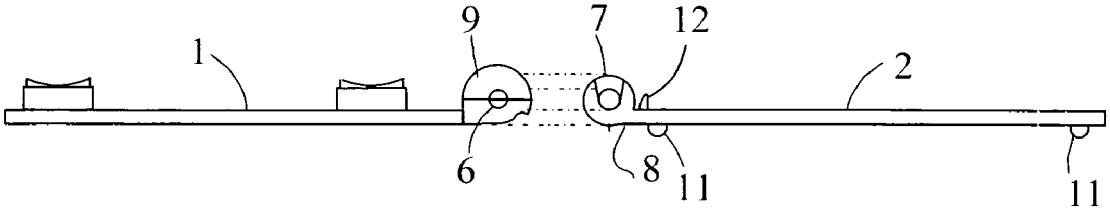
FIG. 11 shows an exploded side view of the device.
Figure 12:
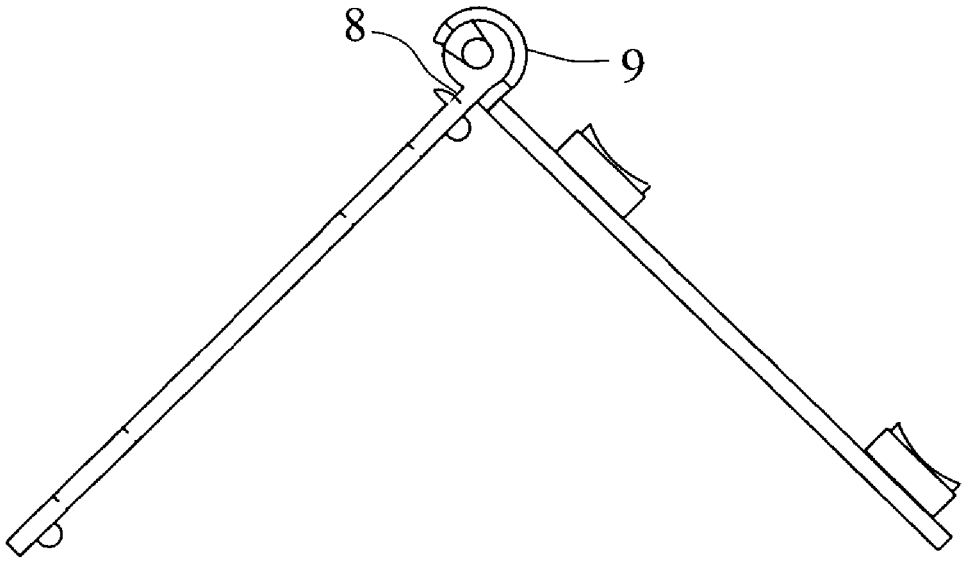
FIG. 12 illustrates the angular state for the device to be assembled or disassembled.

The hinge assembly 3 includes on one side the male part 6 or axle part 6 and on the other the female part 7 or swivel part 7. The assembly allows the male plate 1 and the female plate 2 of the punch to rotate with respect to each other until the plates abut each other. The hinge also ensures that the male punch projections 4 fit exactly into the female slots 5 as the device is closed. As shown in FIG. 2, 4 and 11 the hinge includes on one side, cam guides 9 that fit grooves 8 located on the other side. In the assembled position, the cam 9 and groove 8 combination prevents the two sides of the hinge from sliding along its axis and coming apart. However, as shown in FIG. 11, the cams 9 do not extend all around the circumference of the hinge 3, thus permitting the hinge 3 to be taken apart when the angle between the male plate 1 and the female plate 2 approaches 270 degrees as shown in FIG. 12. In this manner the punch mechanism can easily be assembled or disassembled. This feature simplifies assembly of the device during manufacturing. It should be noted that the hinge mechanism can be reversed, that is the grooves can be placed in the male plate and the cam in the female plate or vice versa.

Figure 13:
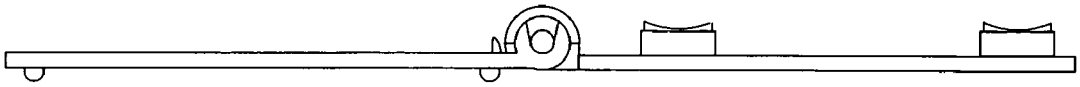
FIG. 13 shows the device open at 180 degrees.
Figure 14:
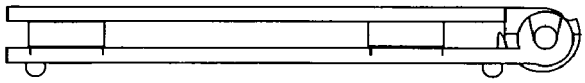
FIG. 14 shows the device in a closed position.

To assemble the device, the male plate 2 and the female plate 1 must be joined together at an angle of approximately 270 degrees. The plates are then slid with respect to each other to engage the hinge. In the 180 degree position shown in FIG. 13 or in the closed position, shown in FIG. 14 the cam and groove are fully engaged and prevent the hinge from sliding, keeping the device securely assembled during normal operation. To perform the disassembly, the reverse operation is performed.

Paper Stop or Card Stop Feature

As shown in FIGS. 1, 2, 3, 4, 11, 12, 13 and 14, guides 12 can be located in the card punch device to facilitate the positioning of the paper inside the device. This guide or paper stop is incorporated on the female plate. It allows the paper inserted into the punch to be placed at an exact and repeatable position. This paper stop should be approximately 1.5 mm wide, 2.5 mm high, and 40 mm long. The edge of the paper stop should be located approximately 1.5 mm from the edge of the hinge assembly. This paper stop should protrude from the female plate and make a 90 degree angle with the surface of the plate on the side presented to the paper.

Figure 15:
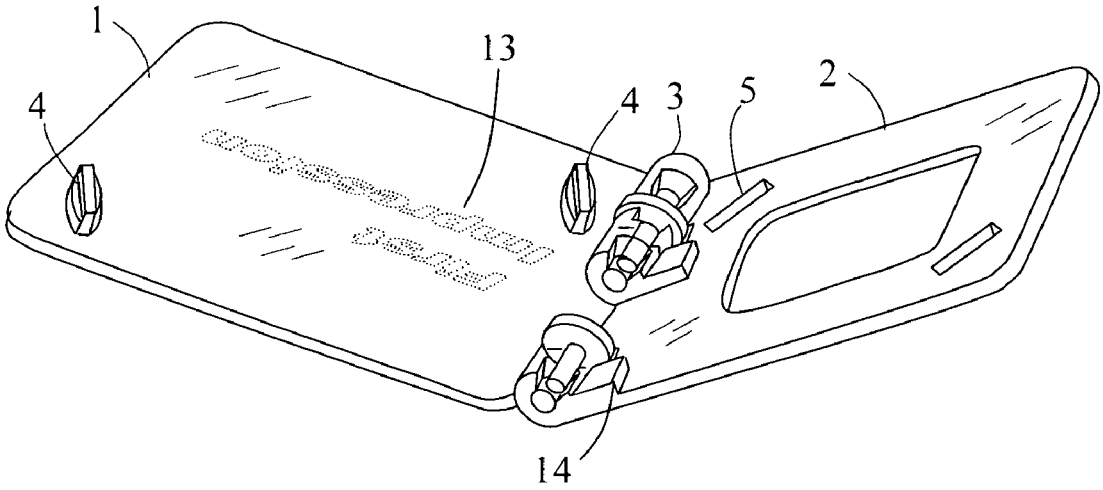
FIG. 15 illustrates the device in an open perspective view. It shows a paper stop as a rectangular block abutting the hinge.
Figure 16:
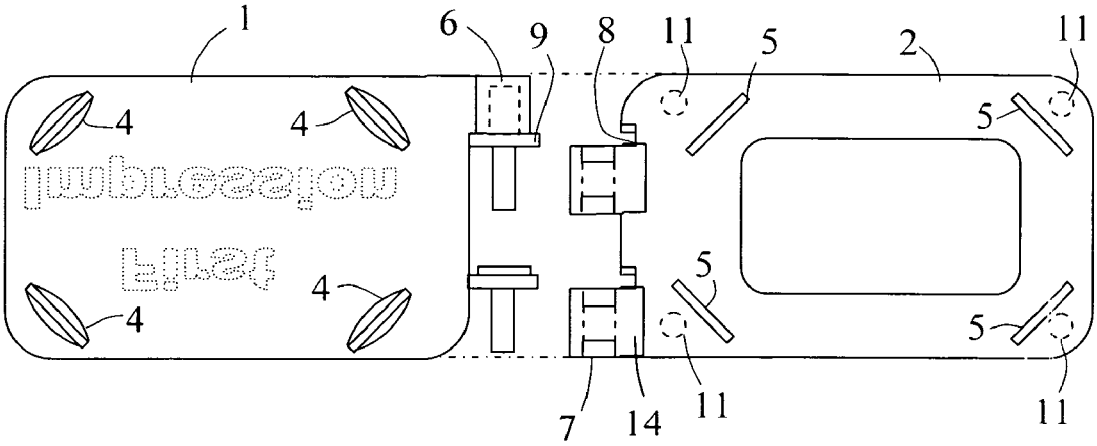
FIG. 16 illustrates the device in an disassembled state. It shows a paper stop as a rectangular block abutting the hinge.

Optionally the paper stop could be constructed as shown in FIGS. 15 and 16. The paper stop 14 would be formed as a rectangular block of plastic abutting the hinge assembly 3. This paper stop 14 would be 1.5 mm wide, 2.5 mm high and 2.5 mm long. Two such paper stops would be fabricated, one for each side of the hinge assembly 3.

As shown in FIGS. 1, 1A, 2, 3, 4, a logo 13 can be inserted on the device. Such a logo 13 can be used to publicize the name of a company for marketing or business purposes.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A paper punch device for cutting narrow rectangular openings in a workpiece to hold diagonally opposite corners of a card, said paper punch device comprising:

a) a male plate generally rectangular in shape and having a hinge edge, said male plate carrying at least one pair of cutting projections, said cutting projections of each said pair positioned on said male plate in a diagonal alignment with respect to said hinge edge, wherein each said cutting projection has a substantially rectangular shape and a cutting edge that forms a closed loop around the periphery of said rectangular-shaped projection, and wherein the long sides of the rectangular-shaped projections of each said pair are substantially parallel to one another; and b) a female plate approximately matching in size said male plate, and moveably hinged to said hinge edge of said male plate by a hinge assembly, said hinge assembly defining a hinge axis substantially parallel to said hinge edge, said female plate being pierced through with rectangular slots, each of said slots being so positioned as to correspondingly face one of said cutting projections in said male plate when said punch device is closed, said slots being the same shape but slightly larger than said cutting projections thereby ensuring that said cutting projections penetrate said slots when said device is closed, said hinge assembly allowing said male plate to be manually rotated about said hinge axis from an open position to a closed position, against said female plate, such that said cutting projections penetrate said slots, said hinge assembly further being rotatable to an open position wherein said hinge edges are freely separable from one another to disassemble the male and female plates from one another, whereby said punch device can be rotated to said closed position to cut said rectangular openings in said workpiece such that said card can be held in place on said workpiece by inserting the corners of said cards into said rectangular openings.

2. The paper punch device as in claim 1 wherein said card is generally dimensioned like a business card.

3. The paper punch device as in claim 1 wherein said hinge assembly comprises an axle part and a swivel part, said axle part comprising one or more cams, and said swivel part comprising one or more grooves, each of said cams being so positioned as to correspondingly penetrate one of said grooves, said cams wrapping around an angle less than the whole circumference of said axle part, thereby engaging said grooves over a range of opening angles of said punch device ranging from approximately 0 to 270 degrees thereby ensuring that for said open positions having said opening angles of approximately 0 to 270 degrees said axle part and said swivel part do not slip with respect to each other and furthermore permitting the easy assembly or disassembly of said punch device for said open positions having opening angles higher than approximately 270 degrees and lower than 360 degrees.

4. The paper punch device as in claim 1 comprising only one said pair of cutting projections and only one corresponding pair of said slots.

5. The paper punch device as in claim 1 comprising two said pairs of cutting projections and two corresponding pairs of said slots.

6. The paper punch device as in claim 1 wherein said rectangular slots are oriented approximately diagonal with respect to the hinge axis with their short sides extending in a direction approximately radially from the center of said female plate, and furthermore wherein each said cutting projection is perpendicular to said male plate, said cutting projections being positioned such as to snuggly fit into said slots when said paper punch device is in said closed position.

7. The paper punch device as in claim 6 wherein said projections have a width between 2 and 2.5 mm, a length of about 18 mm, and a height of about between 6 mm and 8 mm above said male plate.

8. The paper punch device as in claim 6 wherein said slots are slightly larger than said projections by a clearance ranging from 0.2 mm to 0.05 mm.

9. The paper punch device as in claim 6 wherein said slots are slightly larger than said projections by a clearance ranging from 0.1 mm to 0.05 mm.

10. The paper punch device as in claim 6 wherein said rectangular slots and said cutting projections have rounded corners thereby minimizing tearing of the edges of holes cut in said workpiece when said workpiece is paper.

11. The paper punch device as in claim 6 wherein said cutting projections have a top surface and side surfaces, the junction between said top surface and said side surfaces defining cutting edges, said top surface having a concave curvature thereby increasing the sharpness of said projections along said cuffing edges.

12. The paper punch device as in claim 6 wherein said projections have a top surface and side surfaces, the junction between said top surface and said side surfaces defining cutting edges, said top surface being rectangular with long sides and short sides and having a concave cylindrical curvature along its long sides thereby increasing the sharpness of said cutting edge in the area located between said short side of its said top surface and the adjoining side surfaces.

13. The paper punch device as in claim 6 also comprising one or more stops to limit closing of the punch device, said stops are mounted on either said male plate or said female plate, and are shorter in height than said cutting projections by an amount less than the thickness of said female plate, thereby ensuring that said cutting projections do not jut out of said female plate through said slots when said paper punch device is in said closed position.

14. The paper punch device as in claim 13 wherein said stops are formed at the base of said cutting projections and made approximately slightly larger than said slots.

15. The paper punch device as in claim 14 wherein said stops have a length of about 18 mm, a width ranging from 5.0 mm to 7.0 mm and a height above said male plate ranging from 3.5 mm to 4 mm.

16. The paper punch device as in claim 14 wherein said stops have a length of about 18 mm, a width of about 6.0 mm and a height above said male plate of about 4 mm.

17. The paper punch device as in claim 1 further comprising a paper stop projection.

18. The paper punch device as in claim 17 wherein said paper stop projection is approximately 1.5 mm high, 2.5 mm wide and 40 mm long and situated on said female plate and approximately 1.5 mm from said hinge assembly.

19. The paper punch device as in claim 1 further comprising a logo of a company.

20. The paper punch device as in claim 1 wherein said cutting projection of each said pair which is closer to said hinge assembly is shorter by about 1 mm than said other cutting projection of said pair which is projections which are farther from hinge assembly.

* * * * *